United States Patent [19]

Herfeld

[11] Patent Number: 4,781,468

[45] Date of Patent: Nov. 1, 1988

[54] MIXING APPARATUS

[76] Inventor: Friedrich W. Herfeld, Wall 1, 5982 Neuenrade, Fed. Rep. of Germany

[21] Appl. No.: 933,874

[22] Filed: Nov. 24, 1986

[30] Foreign Application Priority Data

Dec. 12, 1985 [DE] Fed. Rep. of Germany ..... 3543913

[51] Int. Cl.[4] ..... B01F 7/20; B01F 9/12

[52] U.S. Cl. ..... 366/213; 366/249; 366/331

[58] Field of Search ..... 366/208, 209, 213, 224, 366/247, 249, 281, 282, 325, 330, 331, 197, 283, 284, 200, 202, 201, 198, 199, 251; 403/334, 361

[56] References Cited

U.S. PATENT DOCUMENTS

| | | | |
|---|---|---|---|
| 1,050,385 | 1/1913 | Palmgren | 403/334 X |
| 1,621,277 | 3/1927 | Richman | 366/331 |
| 2,438,574 | 3/1948 | O'Neill | 366/200 X |
| 2,678,809 | 5/1954 | Seilberger | 366/199 X |
| 2,802,649 | 8/1957 | Stockton | 366/197 |
| 3,204,283 | 9/1965 | Damron | 366/244 X |
| 4,135,828 | 1/1979 | Cabak | 366/224 X |
| 4,432,650 | 2/1984 | Langen et al. | 366/197 X |
| 4,671,666 | 6/1987 | Herfeld | 366/197 |
| 4,676,658 | 6/1987 | Herfeld | 366/249 X |

*Primary Examiner*—Harvey C. Hornsby
*Assistant Examiner*—Scott J. Haugland
*Attorney, Agent, or Firm*—Learman & McCulloch

[57] ABSTRACT

The invention relates to mixing apparatus with a mixing vessel consisting of two vessel parts of which the first vessel part is constructed so as to be transportable and the second vessel part bears a rotatable mixing tool the hub of which is releasably coupled to the drive shaft (11) of a drive motor. The first vessel part is covered by the second vessel part even in its transport state. This mixing apparatus permits a rapid change of product while avoiding cleaning work on the second vessel part and the mixing tool.

9 Claims, 2 Drawing Sheets

MIXING APPARATUS

The invention relates to mixing apparatus of particular utility in the dye, pharmaceutical, plastic processing and food industries.

BACKGROUND OF THE INVENTION

Mixing apparatus of this type is described for example in German Patent Specification No. C-21 10 047. In this known mixing apparatus a first vessel part which is provided with a base outlet also functions as a transport vessel. After the mixing of a material charge it can also be used to transport the finished charge for further use or for storage. A second vessel part is fixed on the horizontal pivot axis of a stationary mounting and is equipped so that it can be releasably connected by means of a clamping device to the peripheral edge of the first vessel part, which is open at the top, to form the actual mixing vessel. In order to be able to produce the connection between the first and the second vessel parts, after the transportable first vessel part has been brought into position below the stationary second vessel part, either the first vessel part is raised by a lifting device or the second vessel part is lowered by a corresponding device. This particular mixing apparatus is distinguished by a good mixing capacity.

SUMMARY OF THE INVENTION

Since such mixing apparatus is frequently used for very different products or types of products, attention must be paid to careful cleaning of at least the second vessel part and its mixing tools in the event of a change of product.

The object of the invention, therefore, is to improve mixing apparatus of this type so that when a change of product is necessary the aforementioned cleaning work can be largely or completely omitted.

In the disclosed embodiment of a mixing apparatus incorporating the present invention the hub of the mixing tool and the motor drive shaft can be connected to one another and released from one another relatively quickly by a coupling arrangement of relatively simple construction and the first vessel part is also covered in its transport state by the second vessel part (together with the mixing tool). Therefore an extremely quick change of the whole mixing vessel on the stationary mounting is possible, so that mixing apparatus constructed according to the invention can be equipped with any number of mixing vessels (each consisting of a first and second mixing vessel and appertaining mixing tool). This means, in other words, that by contrast with the known mixing apparatus described earlier, in the construction according to the invention each complete mixing vessel (consisting of a first and second vessel part) has its own mixing tool and the first vessel part which is constructed in the form of a transportable vessel can be covered by the second vessel part outside the stationary mounting in each phase. This results in a number of considerable advantages. When a change of product is necessary it is only necessary to take another complete mixing vessel. Thus, any expenditure on cleaning (such as is necessary in the known mixing apparatus) of the second vessel part and the mixing tool can be omitted. The drive unit, consisting of the drive motor and the pivot means, does not come into contact with the product and can be of similar construction for all mixing vessels. Since the first vessel part, which is supplied with a product charge, is covered by the second mixing vessel part in almost all operating phases of the mixing vessel, in practice no impurities or other influences on the mixing constituents occur from outside during transport, mixing, storage and emptying.

Even when in a construction according to the invention each mixing vessel is equipped with its own second vessel part and its own mixing tool. The slight increase in construction cost is more than compensated for by the advantages which can be achieved. This is particularly evident where a relatively frequent change of product is necessary. In previously known mixing apparatus considerable cleaning work would have to be carried out on the second vessel part and the mixing tool.

THE DRAWINGS

The invention will be explained in greater detail below on the basis of one embodiment which is illustrated in the drawings: wherein.

DETAILED DESCRIPTION

Figure 1:
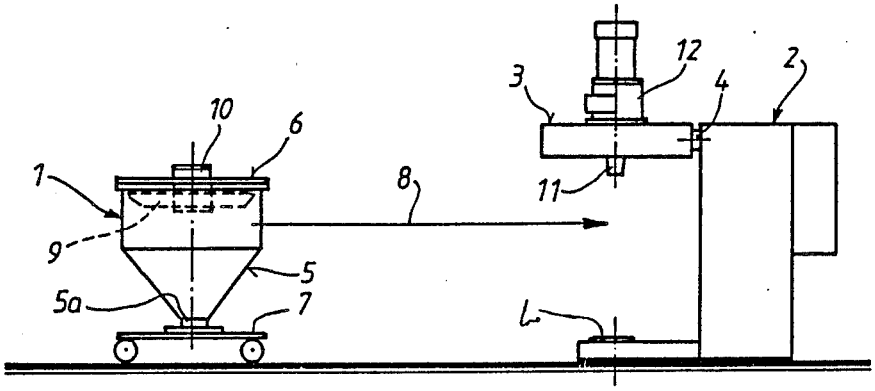
FIGS. 1 and 2 show simplified schematic representations of the mixing apparatus according to the invention at two different stages of use.
Figure 2:
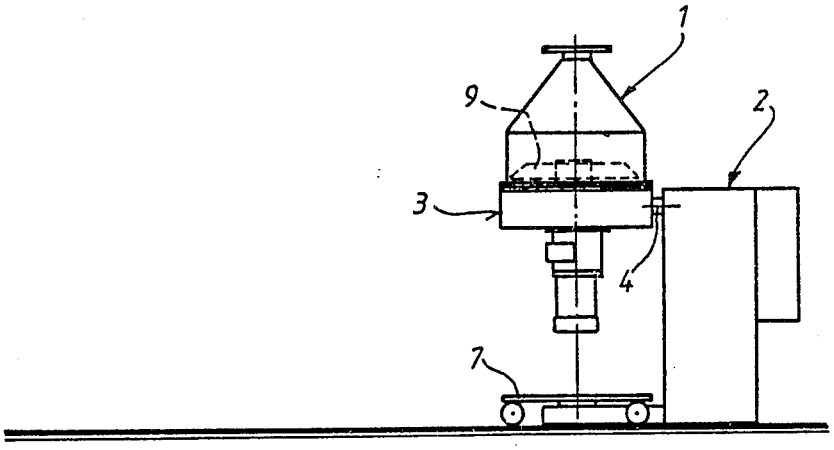

First of all the mixing apparatus will be described generally on the basis of the schematic representations in FIGS. 1 and 2. It contains a mixing vessel 1 and a stationary mounting 2 having a supporting frame 3 which can be pivoted about a horizontal shaft 4 by at least 180°. The mixing vessel 1 consists essentially of two vessel parts 5 and 6 which can be connected to one another, of which the first vessel part 5 is constructed in the form of an upright transport vessel and can be moved on a wagon 7. Since in this construction—as will be explained in greater detail below—the second vessel part 6 is arranged so as to be fixed but removable in the form of a cover on the first vessel part 5, the whole mixing vessel 1 can be moved on the wagon 7.

When the mixing vessel 1 has been moved in the necessary manner in the direction of arrow 8 in FIG. 1 so that it is below the supporting frame 3 of the stationary mounting 2, an appropriate lifting device L moves the mixing vessel 1 upwards towards the supporting frame 3, so that the supporting frame 3 and the mixing vessel 1 can be connected to one another in such a way that the mixing vessel 1 is carried by the supporting frame. From this starting position is which the mixing vessel 1 is suspended approximately vertically below the supporting frame 3 the mixing vessel can be pivoted by the pivot movement of the supporting frame 3 about the shaft 4 by approximately 180° so that the mixing vessel 1 then takes up the mixing position illustrated in FIG. 2.

The second vessel part 6 can be constructed in a cup shape, or preferably and more simply in the form of a cover plate (as will be explained in greater detail below with the aid of FIG. 3), and a mixing tool 9 of known construction (for example in the form of mixing blades) is rotatably mounted on the second vessel part 6. As can be seen from FIG. 1, the hub 10 of the mixing tool 9 projects somewhat beyond the upper face of the second vessel part 6. In the starting position according to FIG. 1 the end 11 of the drive shaft of a drive motor 12, which is carried approximately centrally by the supporting frame 3 and is pivotable with the latter, projects approximately vertically downwards and can be releasably coupled to the hub of the mixing tool 10.

Figure 3:
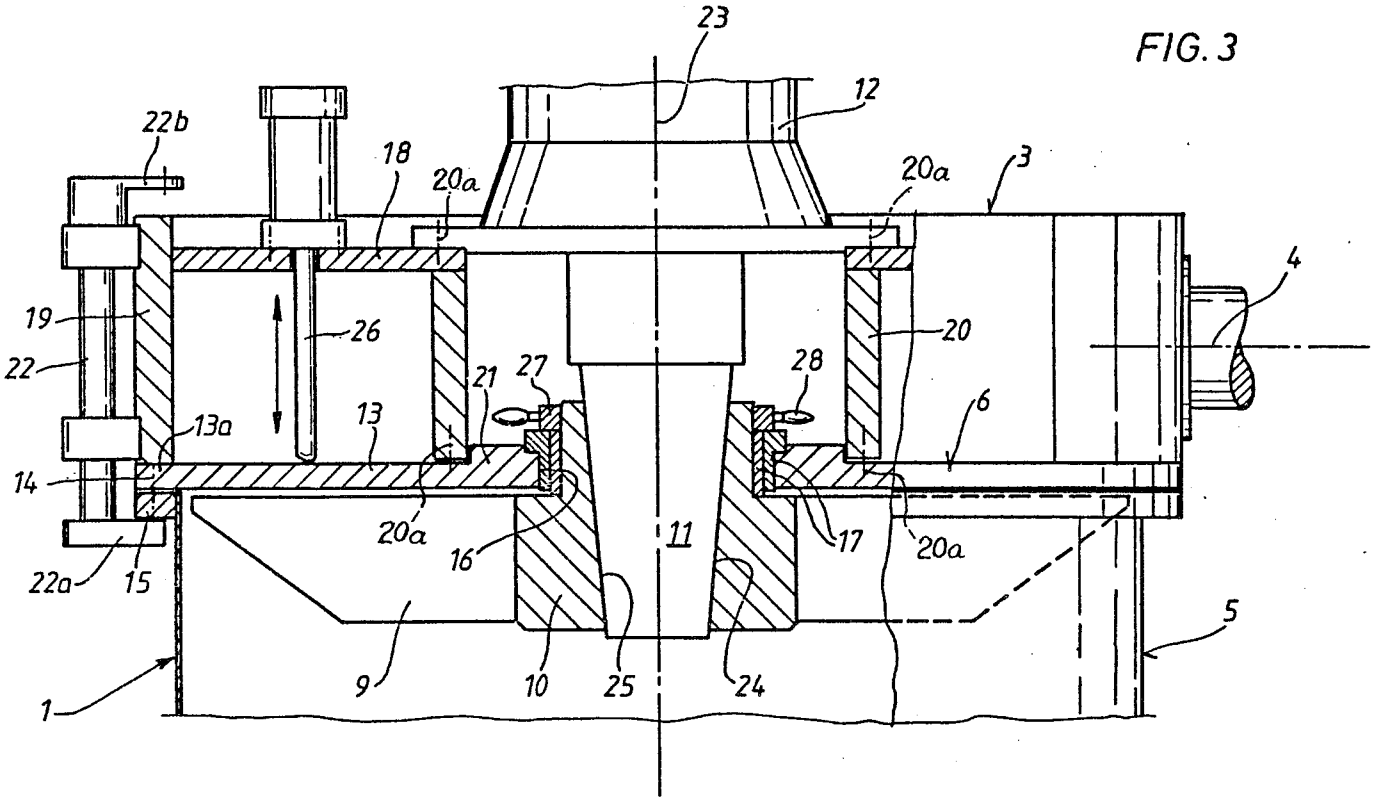
FIG. 3 shows a partial cross-sectional view in the region of the connection between the first and second vessel parts and between the second vessel part and the pivot mounting and the drive motor.

In an enlarged partial sectional view, FIG. 3 shows in greater detail the releasable connection of the second vessel part 6 to the upper open end of the first vessel part 5 on the one hand and to the supporting frame 3 and the end 11 of the drive shaft of the drive motor 12 on the other hand.

As regards the construction of the second vessel part 6, this can be seen clearly from FIG. 3 as having an essentially flat cover plate 13 with an outer peripheral flange 13*a* which is releasably connected to an upper flange ring 15 of the first vessel part 5 (for example by screws 14 which are indicated by dot-dash lines). The cover plate 13 also has a central bearing bore 16 in which sealing and bearing bushes 17 are arranged for a sealed rotatable mounting of the hub 10 of the mixing tool. Details of the exact construction of this rotary mounting have been omitted for the sake of simplicity since they are known per se). The hub 10 carries the mixing tool 9 which —as already indicated—can be a plurality of mixing blades distributed around the periphery of the hub.

As can be seen from FIG. 3, the supporting frame 3 is made up essentially of an upper carrier plate 18, an outer cylindrical carrier ring 19, and an inner cylindrical centering ring 20 which is directed towards the the second vessel part 6 and the cover plate 13. The centering ring 20 comes into engagement with a spigot 21 projecting towards the supporting frame 3. The spigot 21, which is integral with the cover plate 13, encloses the bearing bore 16 and is constructed so as to taper slightly towards the top to engage and center in the end of the centering ring 20 which is directed towards it when the supporting frame 3 and the mixing vessel 1 are connected to one another.

The free end of the outer carrier ring 19 of the supporting frame 3 butts against the outer peripheral flange 13*a* of the cover plate 13 and has a plurality of clamping shoes 22 distributed over the external periphery. These clamping shoes 22 can be of known construction (and are therefore not explained in greater detail) and when the connection between the supporting frame 3 and the mixing vessel 1 is produced their lower ends 22*a* engage under the flange ring 15 of the first vessel part 5 and thereby produce a firm but releasable connection between the carrier ring and the mixing vessel. The upper ends 22*b* of the clamping shoes are connected to a drive which is not shown in greater detail in order to rotate the clamping shoes 22 about their longitudinal axis.

As has already been explained, the supporting frame 3 carries the drive motor 12 approximately centrally (on its carrier plate 18) and—as shown in FIG. 3—the drive motor is fixed concentrically with the centering ring 20 in such a way that in the assembled state the end 11 of the drive shaft of this drive motor 12 and the axis of the hub 10 lie on a common axis 23 which at the same time forms the vertical axis of the mixing vessel 1.

When the mixing vessel 1 is being connected to the supporting frame 3 the hub 10 of the mixing tool should also be coupled to the end 11 of the drive shaft, which can be done in any suitable manner using coupling means which are known per se. An exemplary drive connection which can be produced particularly simply and quickly between the end 11 of the shaft and the hub 10 of the mixing tool is produced by a clamping cone connection containing a clamping cone 24 which is constructed on the end 11 of the drive shaft and tapers towards the hub 10 and a central conical bore 25 in the hub 10 which widens towards the clamping cone 24. Thus in the known construction when the supporting frame 3 is connected to the mixing vessel 1 the hub 10 is simultaneously coupled reliably and accurately to the end 11 of the drive shaft of the drive motor 12, aided by the centering ring 20 and the spigot 21.

Whilst the closing force between the supporting frame 3 and the mixing vessel 1 is sufficient for coupling together the hub 10 of the mixing tool and the end 11 of the drive shaft, when this drive connection is uncoupled it can be advantageous to exert a lift-off force on the cover plate 13 of the second vessel part 6 from the side of the supporting frame in order to release the hub 10 with its conical bore 25 from the clamping cône 24 at the end 11 of the drive shaft. For this purpose a release mechanism which is equipped with at least one but preferably at least two push rods 26 and acts against the upper face of the cover plate 13 of the second vessel part 6 is provided on the supporting frame 3; the push rods 26 can be constructed in any suitable manner, but push rods which are connected to the piston rod of a cylinder-piston unit which is operated by a pressure medium and work quickly and reliably are preferred.

On the end of the hub 10 of the mixing tool which projects out of the second vessel part 6 over the spigot 21 of the cover plate 13 a setting ring 27 can also be provided which surrounds the said end of the hub and acts with its underside (FIG. 3) against the upper ends of the sealing and bearing bushes 17 in the cover plate 13. When the end 11 of the drive shaft and the hub 10 of the mixing tool are coupled together the mixing vessel 1 with the mixing tool 9 must be pushed against the drive shaft, i.e. the conical bore 25 is pushed onto the clamping cone 24, in order to obtain a force-locking connection. Here an abutment is produced by the setting ring 27 pushing against the upper face of the cover plate 13. In order that this force-locking clamping cone connection can be maintained particularly reliably after the supporting frame 3 with the mixing vessel 1 has been pivoted into its mixing position (FIG. 2), additional screws or bolts, indicated by dash-dot lines 20*a*, for adjusting the extent that the shaft 11 extends into the bore 25 can be provided in the region of the centering ring 20 and spigot 21.

Handles 28 can also be fixed on the setting ring 27 so that it is possible to turn the hub 10 and with it the mixing tool 9 from the outside in case of need (i.e. particularly when filling the mixing vessel 1) in order to distribute the material evenly in the mixing vessel 1 at the top.

The mixing process can be carried out in a manner which is known per se using this mixing apparatus. For this purpose the mixing vessel 1 is filled with a product charge in a suitable manner outside the stationary mounting 2, which can be achieved by lifting off the second vessel part 6 which is positioned uppermost and—after filling it with the charge—immediately closing the apparatus again with this second vessel part 6. However, it is even simpler to use the central conical bore 25 of the hub 10 of the mixing tool as a charging opening for the mixing vessel 1, and this bore can also be covered by a simple cover during the transport or storage of the mixing vessel 1. For the mixing operation the mixing vessel 1 is brought to the stationary mounting and is connected to the supporting frame 3 by being raised or by lowering of the supporting frame, and at the same time a force-locking coupling between the mixing tool 9 and the drive motor 12 is produced (by means of the clamping cone connection described above). The supporting frame 3 together with the mixing vessel 1 then pivots out of this starting position by approximately 180° (about the axis 4) into the mixing position shown in FIG. 2. After mixing has been carried out the assembly consisting of the supporting frame 3 and the mixing vessel 1 pivots back into the starting position in which the mixing vessel 1 is released from the supporting frame 3 in the reverse sequence.

It goes without saying that other constructions can be used for the coupling means, such as for example a claw coupling, screw coupling, bayonet catch or the like.

By means of the construction of the mixing apparatus described above the mixing vessel 1 can be changed on the supporting frame 3 particularly simply and thus a very quick change of product can be carried out, and practically no cleaning is necessary for the second vessel part and the mixing tool. This mixing apparatus can be used particularly advantageously in the dye, pharmaceutical, plastic processing and food industries.

What is claimed is:

1. Mixing apparatus comprising a support; rotary driving means having a rotatable drive shaft; means mounting said driving means on said support; a mixing vessel comprising an upright bowl having an open upper end; a cover for said bowl; means for securing said cover to said bowl at its upper end; mixer blade means; a rotatable hub secured to said mixer blade means; means journalling said hub on said cover for rotation; means reacting between said hub and said cover for locating said mixer blade means adjacent said cover and within said bowl at said upper end thereof; means for effecting relative movement of said bowl and said driving means toward and away from one another, said driving means and said hub being responsive to relative movement of said bowl and said driving means a predetermined distance toward one another to drivingly couple said shaft and said hub to one another; means for separably securing said vessel to said support with said shaft and said hub drivingly coupled; and means for rotating said support through substantially 180° while said vessel is secured thereto to invert said vessel and locate said cover at the bottom of said inverted vessel.

2. Mixing apparatus according to claim 1 wherein said hub has a bore therein, said shaft when coupled with said hub being accommodated in said bore.

3. Mixing apparatus according to claim 2 wherein said bore is tapered, and said shaft is complementally tapered.

4. Mixing apparatus according to claim 3 wherein said tapered bore extends completely through said hub.

5. Mixing apparatus according to claim 4 wherein said shaft is operable to seal said bore.

6. Mixing apparatus according to claim 1 wherein said cover has an opening therein through which said hub extends and a spigot on its upper surface encircling said opening, and wherein said support has a centering ring confronting said cover and being nestable with said spigot in response to said relative movement of said vessel and said support for coaxially aligning said hub and said shaft.

7. Mixing apparatus according to claim 1 including power release means carried by said support, said release means including extensible and retractable means engageable with said cover when said driving shaft and said hub are engaged, said extensible and retractable means being operable to effect separation of said shaft and said hub.

8. Mixing apparatus according to claim 1 including adjustable means reacting between said support and said driving means for varying the extent said shaft may extend into said hub.

9. Mixing apparatus according to claim 1 wherein said hub has a bore therethrough forming an inlet into said vessel through which material to be mixed may be introduced to said vessel, said bore being sealed by said shaft when said shaft and said hub are coupled together.

* * * * *